US007518601B2

(12) United States Patent
Nakayama et al.

(10) Patent No.: US 7,518,601 B2
(45) Date of Patent: Apr. 14, 2009

(54) ARRAY SUBSTRATE AND DISPLAY APPARATUS AND METHOD FOR MANUFACTURING DISPLAY APPARATUS

(75) Inventors: Akio Nakayama, Kumamoto (JP); Shuichi Iida, Tokyo (JP)

(73) Assignees: Mitsubishi Denki Kabushiki Kaisha, Chiyoda-Ku, Tokyo (JP); Optrex Corporation, Arakawa-Ku, Tokyo (JP)

( * ) Notice: Subject to any disclaimer, the term of this patent is extended or adjusted under 35 U.S.C. 154(b) by 843 days.

(21) Appl. No.: 11/044,279

(22) Filed: Jan. 28, 2005

(65) Prior Publication Data

US 2005/0168456 A1 Aug. 4, 2005

(30) Foreign Application Priority Data

Jan. 29, 2004 (JP) ..... 2004-021021

(51) Int. Cl.
*G09G 5/00* (2006.01)

(52) U.S. Cl. ..... 345/204; 345/98; 345/55

(58) Field of Classification Search ..... 345/204, 345/98, 55

See application file for complete search history.

(56) References Cited

U.S. PATENT DOCUMENTS 6,979,839 B2 * 12/2005 Murade ..... 257/59
6,982,694 B2 * 1/2006 Matsuzaki ..... 345/98

FOREIGN PATENT DOCUMENTS

| | | |
|---|---|---|
| JP | 5-4044 | 1/1993 |
| JP | 5-5866 | 1/1993 |
| JP | 9-264917 | 10/1997 |
| JP | 2000-81635 | 3/2000 |
| JP | 2003-50551 | 2/2003 |
| JP | 2003-14075 | 5/2003 |
| JP | 2003-167265 | 6/2003 |

OTHER PUBLICATIONS

Japanese Office Action in corresponding Japanese application, along with English language translation of Japanese Office Action.

* cited by examiner

*Primary Examiner*—Richard Hjerpe
*Assistant Examiner*—Leonid Shapiro
(74) *Attorney, Agent, or Firm*—Buchanan Ingersoll & Rooney PC

(57) ABSTRACT

An array substrate according to the invention includes an external terminal formed in the vicinity of an end portion of an insulating substrate so as to supply electric potential from the exterior to a driving circuit, a signal line monitoring terminal formed in parallel with the external terminal, a signal line branch terminal formed in such a way as to be connected to a signal line or to a signal line terminal, and an internal terminal associated with the signal line monitoring terminal, which is connected to the signal line monitoring terminal and connectable to a signal line branch terminal by an electrically conductive material and a bump of the driving circuit.

4 Claims, 6 Drawing Sheets

ARRAY SUBSTRATE AND DISPLAY APPARATUS AND METHOD FOR MANUFACTURING DISPLAY APPARATUS

BACKGROUND OF THE INVENTION

1. Field of the Invention

The present invention relates to an array substrate and a display apparatus, each of which is adapted so that the monitoring of electric potential supplied to a signal line can be observed (or monitored) and that occurrence of electrostatic destruction can be prevented, and to a method for manufacturing the display apparatus.

2. Description of the Related Art

In a conventional display apparatus, for example, when various defects caused in a completed product are analyzed, first, monitoring electrodes are individually connected to scanning-signal wires and/or video signal wires outside a display area. Then, defect analysis is performed according to the conditions of pixels associated with each of the monitoring electrodes and the display conditions of those disposed within a display area in a driven state (see, for instance, JP-A-9-264917).

Further, another conventional display apparatus has an inspection circuit that includes gate-side output monitoring terminals and source-side output monitoring terminals, which output inspection signals through gate-line short links and source-line short links. Defects, such as short circuiting and breaking of wires in the display apparatus can be inspected according to the inspection signals outputted from the monitoring terminals (see, for example, JP-2003-50551).

However, the former conventional display apparatus has problems that although the state of the defects can be judged according to the display condition by using the monitoring electrodes, the condition of electric potential actually applied to signal lines cannot be monitored, and that analysis of defects due to a defective output voltage of a drive circuit or the like cannot be achieved.

Incidentally, in the case of the latter conventional display apparatus, although the electric potential applied to the short link can be monitored by using the gate-side output monitoring terminal or the source-side output monitoring terminal, the short links are cut off before a final product is obtained. Thus, it is impossible to perform the defect analysis by observing of a voltage applied to the actual signal line and by monitoring electric potential applied to each of the signal lines after the product is actually obtained.

SUMMARY OF THE INVENTION

The invention is accomplished in view of such problems. Objects of the invention are to provide an array substrate and a display apparatus, each of which is adapted so that the defect analysis can be performed by monitoring electric potential supplied to a signal line after a completed product is obtained, and that occurrence of electrostatic destruction can be prevented, and to a method for manufacturing the display apparatus.

According to an aspect of the invention, there is provided an array substrate that includes an insulating substrate on which plural signal lines are formed, a signal line terminal formed on the insulating substrate in such a manner as to be connected to a driving circuit, which supplies signals to the plural signal lines, by a conductive material, an external terminal, formed in vicinity of an end portion of the insulating substrate, for externally supplying electrical potential to the driving circuit, a signal line monitoring terminal formed in parallel with the external terminal, a signal line branch terminal formed in such a way as to be connected to the signal line or to the signal line terminal, and an internal terminal associated with the signal line monitoring terminal, which is connected to the signal line monitoring terminal and connectable to the signal line branch terminal by the conductive material and a bump of the driving circuit.

The invention can provide an array substrate and a display apparatus, each of which is adapted so that the defect analysis can be performed by monitoring electric potential supplied to a signal line after a completed product is obtained, and that occurrence of electrostatic destruction can be prevented, and also can provide a method for manufacturing the display apparatus.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

First Embodiment

Figure 1:
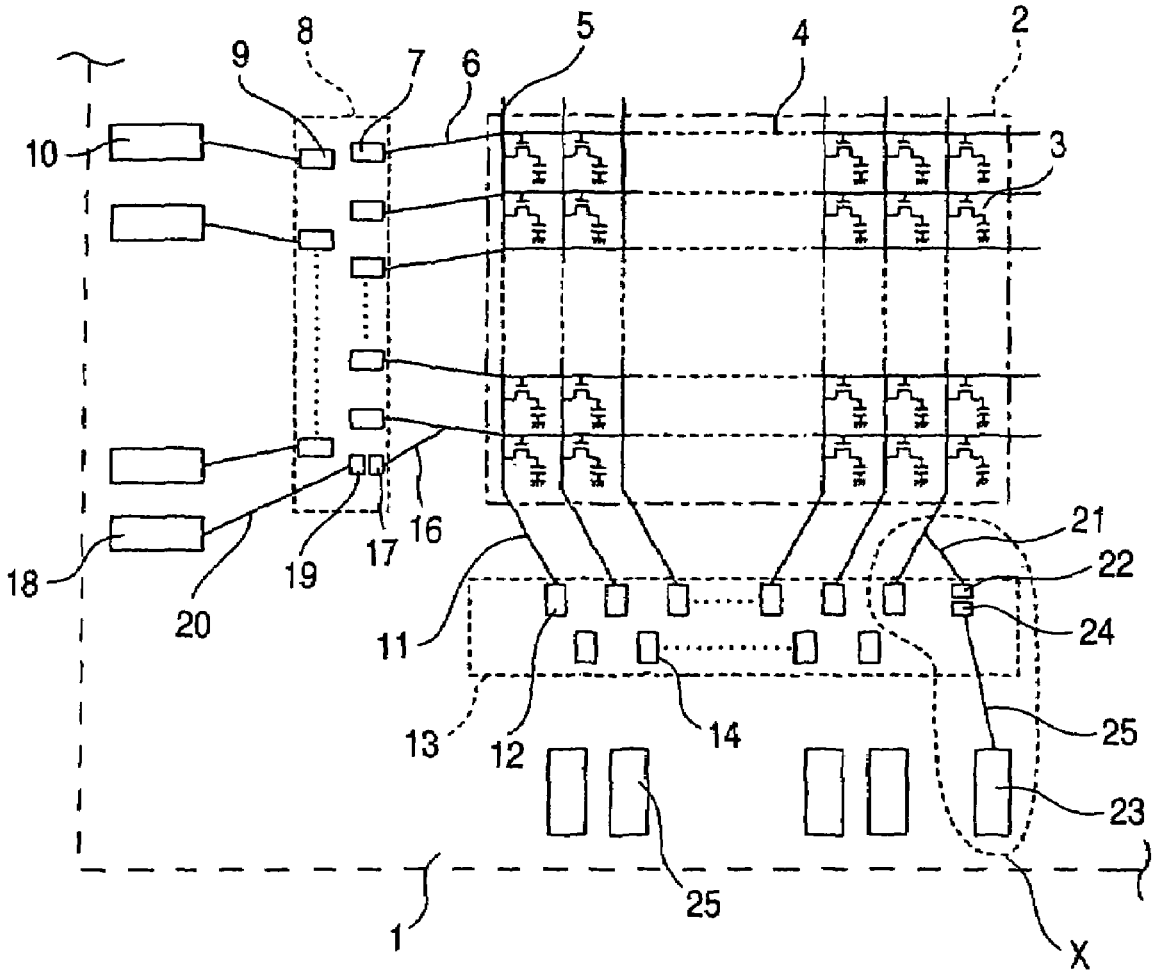
FIG. 1 is an equivalent circuit diagram illustrating a display apparatus according to a first embodiment of the invention.
Figure 2A:
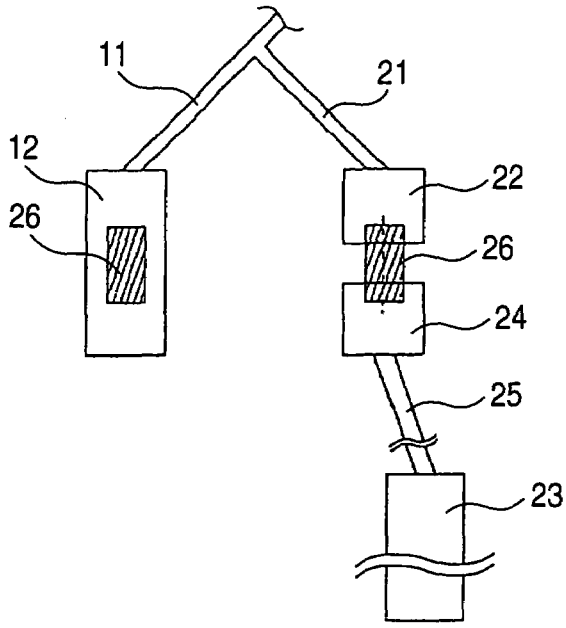
FIGS. 2A and 2B are enlarged diagrams each illustrating a video signal line monitoring terminal portion X shown in FIG. 1.
Figure 2B:
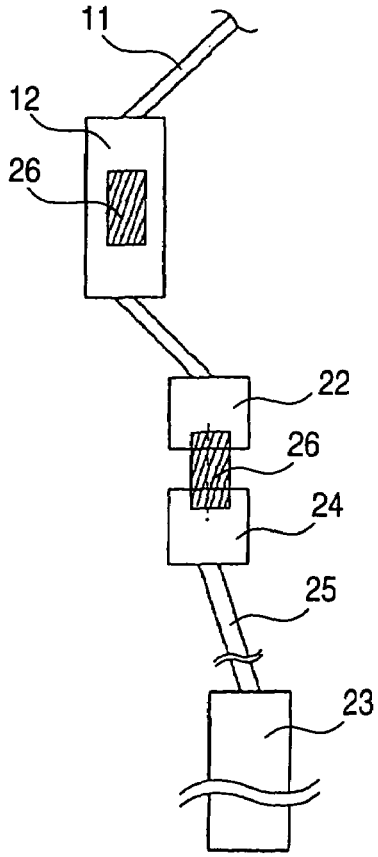
Figure 3:
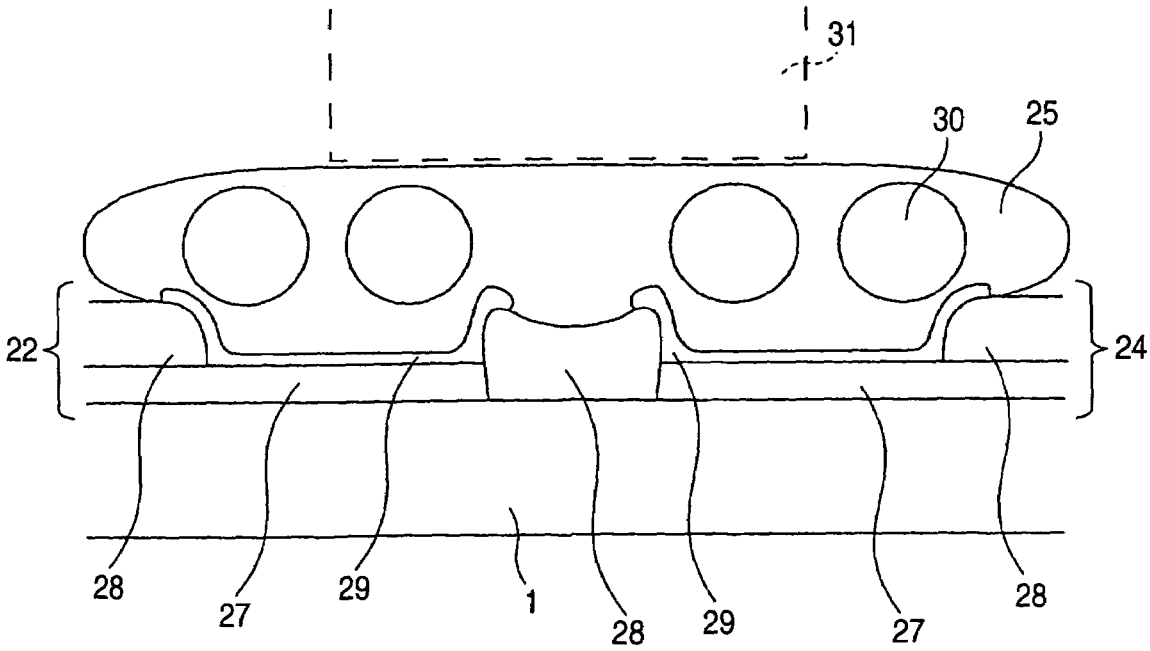
FIG. 3 is a cross-sectional diagram taken along line A-A shown in each of FIGS. 2A and 2B.

A first embodiment of the invention is described hereinbelow by referring to FIGS. 1 to 3. FIG. 1 shows an equivalent circuit diagram of a display apparatus of the first embodiment of the invention. FIGS. 2A and 2B are enlarged diagrams of a video-signal-line-side monitoring terminal portion X shown in FIG. 1. FIG. 3 is a cross-sectional diagram taken on line A-A shown in each of FIGS. 2A and 2B.

As shown in FIG. 1, scanning lines 4, which are connected to the gates of thin film transistors 3 respectively provided in pixels constituting a display area 2 and supply scanning signals thereto, and video signal lines 5, which are connected to the sources of the thin film transistors 3 and supply video signals thereto, are disposed on an insulating substrate 1. The scanning lines 4 are drawn to the outside of the display area 2 through scanning line lead-out wires 6 and connected to signal line terminals 7 thereof. A scanning line driving circuit 8 is mounted on the insulating substrate 1 by connecting bumps (or terminals) formed on a surface of the scanning line driving circuit 8, which faces the insulating substrate, to the signal line terminals 7 associated with the scanning lines through an electrically conductive material, such as ACF (Anisotropic Conductive Film). Simultaneously, input terminals 9 of a power supply and so forth of the scanning line driving circuit are connected to the bumps formed on the surface of the scanning line circuit 8, which faces the insulating substrate, by the conductive material. The input terminals 9 of this scanning line driving circuit are connected to scanning-line-side external terminals 10 provided in the vicinity of end portions of the insulating substrate 1. Various kinds of voltages are inputted to the scanning line driving circuit 8 by externally inputting various electric power to the scanning-line-side external terminals 10.

Similarly, video signal lines 5 are drawn to the outside of the display area 2 through vide signal line lead-out wires 11, and connected to signal line terminals 12 associated with the video signal lines. A video signal line driving circuit 13 is mounted on the insulating substrate 1 by connecting bumps formed on a surface of the video signal line driving circuit 13, which faces the insulating substrate, to signal line terminals 12 associated with the video signal lines. Simultaneously, input terminals 14 of a power supply and so on of the video signal line driving circuit formed on the insulating substrate 1 are connected to the bumps formed on the surface of the video signal line driving circuit 13, which faces the insulating substrate, by the conductive material. The input terminals 14 of this video signal line driving circuit are connected to video-signal-line-side external terminals 15 provided in the vicinity of end portions of the insulating substrate 1. Various voltages are inputted to the video signal line driving circuit 13 by externally inputting various electric power to the video-signal-line-side external terminals 15.

As described above, various kinds of signal lines and pixels are formed on the insulating substrate. Thus, an array substrate is completed. Thereafter, a display apparatus is completed by setting a liquid crystal to be sandwiched between an opposing substrate (not shown) and the array substrate.

In the display apparatus of the aforementioned configuration, a scanning line branch terminal 17 connected to a branch wire 16 formed in such a way as to be connected to one of endmost parts of the group of the scanning lines 4 is formed. Further, a scanning line monitoring terminal 18 formed in parallel with the scanning-line-side external terminals 10 is formed in the vicinity of an end portion of the insulating substrate 1. This scanning line monitoring terminal 18 is connected by a scanning line monitoring wire 20 to an internal terminal 19 associated with the scanning line monitoring terminal 18. Furthermore, this internal terminal 19, which is associated with the scanning line monitor terminal, and the scanning line branch terminal 17 are formed by setting the distance therebetween at, for example, about 10 .m to 20 .m so as to be connected by the conductive material, such as ACF, to, for instance, dummy bumps when the scanning line driving circuit 8 is mounted on the insulating substrate. Setting this distance to be equal to or more than 10 .m results in low possibility of occurrence of short-circuiting due to foreign matters produced during the manufacturing process of the apparatus. Moreover, setting this distance to be equal to or less than 20 .m causes the mainstream size of the bumps to be range from about 60 .m to about 70 .m and also causes the mainstream diameter of conductive particles included in the ACF or the like to be about 5 .m. Therefore, such setting of the distance therebetween is preferable because stable connection therebetween is achieved.

Similarly, regarding the video signal line side, a scanning line branch terminal 22 connected to a branch wire 21 formed in such a way as to be connected to one of endmost parts of the group of the video signal lines 5 is formed. Further, a video signal line monitoring terminal 23 formed in parallel with the video-signal-line-side external terminals 15 is formed in the vicinity of an end portion of the insulating substrate 1. This video signal line monitoring terminal 23 is connected by a video signal line monitoring wire 25 to an internal terminal 24 associated with the video signal line monitoring terminal 23. Furthermore, this internal terminal 24, which is associated with the video signal line monitor terminal, and the video signal line branch terminal 22 are formed by setting the distance therebetween at, for example, about 10 .m to 20 .m so as to be connected by the conductive material, such as ACF, to, for instance, dummy bumps when the video signal line driving circuit 13 is mounted on the insulating substrate, as described above.

FIGS. 2A and 2B are enlarged diagrams of a vide signal line monitoring terminal portion X shown in FIG. 1 (that is, diagrams each showing a pattern formed on the insulating substrate), and shows a state in which the conductive material, such as ACF, is applied thereto. First, as shown in FIG. 2A, the video signal line branch terminal 22 connected to the branch wire 21, which is formed in such a way as to be connected to the video signal line lead-out wire 11, is formed at one of the endmost portions of the group of video signal lines 5. Further, the video signal line monitoring terminal 23 formed in parallel with the video-signal-line-side external terminal is formed in the vicinity of an end portion of the insulating substrate 1. This video signal line monitoring terminal 23 and the internal terminal 24, which is associated with the video signal line monitoring terminal, are connected by the video signal line monitoring wire 25 to each other. Furthermore, this internal terminal 24, which is associated with the video signal line monitor terminal, and the video signal line branch terminal 22 are formed by setting the distance therebetween at, for example, about 10 .m to 20 .m, as described above, so as to be connected by the conductive material, such as ACF, to, for instance, dummy bumps when the video signal line driving circuit is mounted on the insulating substrate. The arrangement of the terminals may be set in such a manner as to connect the video signal line branch terminal 22 to the signal line terminal, which is associated with the video signal line, by the pattern formed on the insulating substrate, as shown in FIG. 2B, instead of forming the branch wire 21 of the video signal line lead-out wire 11. The rest of the configuration is similar to that shown in FIG. 2A.

Next, FIG. 3 is a cross-sectional diagram taken on line A-A shown in each of FIGS. 2A and 2B. Further, the bump of the driving circuit is indicated by dashed lines therein. After patterning a metallic film 27 so that each of the terminals and the wires are shaped on the insulating substrate 1, an insulating film including a connecting region of each of the video signal line branch terminal 22 and the video signal line monitoring terminal, which is connected with a bump 31 of the driving circuit, is eliminated (etched). Patterning is performed on a transparent conductive film 29 in such a manner as to include the connecting region. With the aforementioned configuration, when the driving circuit is mounted on the insulating substrate, for example, a dummy bump 31 formed on a surface of the video signal line driving circuit or the scanning line driving circuit, which faces the insulating substrate, is pressure-attached to a corresponding part of each of the internal terminal 24, which is associated with the video signal line monitoring terminal, and the video signal line branch terminal 22 through the conductive material 26. A transparent conductive film 29 and the bump of the driving circuit, which are formed on the insulating substrate, are connected to each other by conductive particles 30 included in the conductive material 26.

Further, the process of connecting the video signal line branch terminal 22 to the internal terminal 24, which is associated with the video signal line monitoring terminal, by the conductive material 26 and the bump 31 of the driving circuit, is performed simultaneously with the process of connecting the signal line terminal 12, which is associated with the video signal line, to the bump of the driving circuit by the conductive material 26. Thus, the configuration including the signal line monitor terminal can be obtained without performing an additional process. Furthermore, the process of forming the video-signal-line-side external terminal 15, the process of forming the video signal line monitoring terminal 23 in parallel with the external terminal 15, the process of forming the signal line branch terminal connected to the video signal line 11 or to the signal line terminal 12 associated with the video signal line, and the process of forming the internal terminal 24, which is associated with and connected to the video signal line monitoring terminal 23 are performed at the same step, so that the entire configuration shown in FIG. 3 is obtained. Consequently, the aforementioned configuration including the signal line monitoring terminal can be obtained.

With the aforementioned configuration, the video signal line branch terminal 22 is not connected to the internal terminal 24 associated with the video signal line monitoring terminal until the driving circuits are mounted. Therefore, in a case where static electricity enters the substrate from an external terminal, which is provided in the proximity of an end portion of the insulating substrate before the driving circuits are mounted, at that moment, the video signal line branch terminal 22 is not connected to the internal terminal 24 associated with the video signal line monitor terminal. Thus, static electricity does not reach the display area. The electrostatic destruction of pixels does not occur. Generally, it is considered that most of the cases where static electricity externally enters the insulating substrate, the static electricity enters from a terminal formed in the vicinity of an end portion of the substrate. With the aforementioned configuration, even in a case where the signal line monitoring terminal is formed thereon, electrostatic destruction can be suppressed.

Incidentally, after the driving circuits are connected thereto, the possibility of allowing static electricity to enter the substrate in the subsequent manufacturing process is low. Moreover, an input portion of the driving circuit is provided with a protective diode for preventing occurrence of electrostatic destruction. Thus, it is extremely seldom that static electricity externally enters and reaches the pixel of the display area and has adverse effects, such as electrostatic destruction. Further, after the drive circuits are connected thereto, electricity is conducted from the video signal line monitoring terminal through the branch wire to the video signal line. This enables the monitoring of the video signal line. The defect analysis is enabled by monitoring variation in the potential applied on the signal line. Furthermore, the operability of a monitor can be enhanced by forming the video signal line monitoring terminal in the vicinity of an end portion of the insulating substrate in parallel with the external terminal associated with the video signal line.

Second Embodiment

Figure 4:
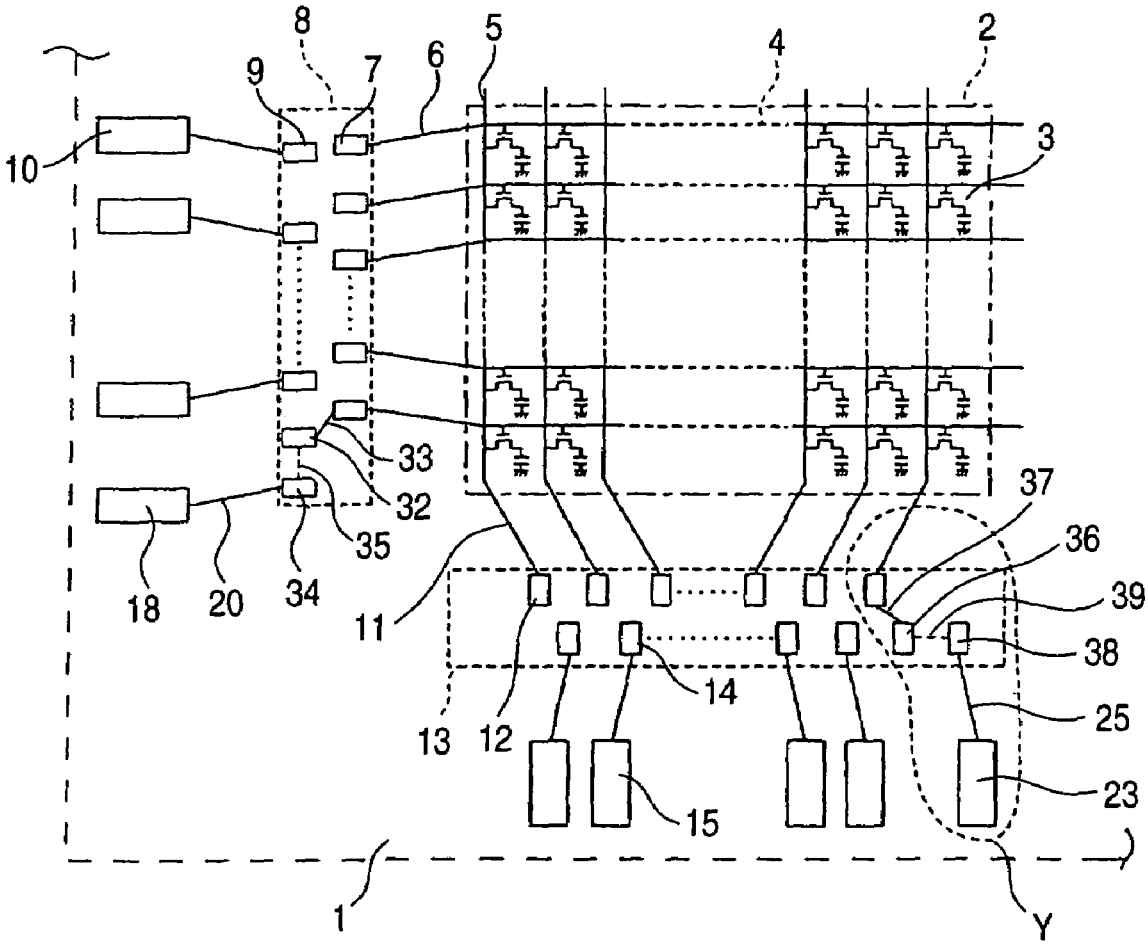
FIG. 4 is an equivalent circuit diagram illustrating a display apparatus according to a second embodiment of the invention.
Figure 5A:
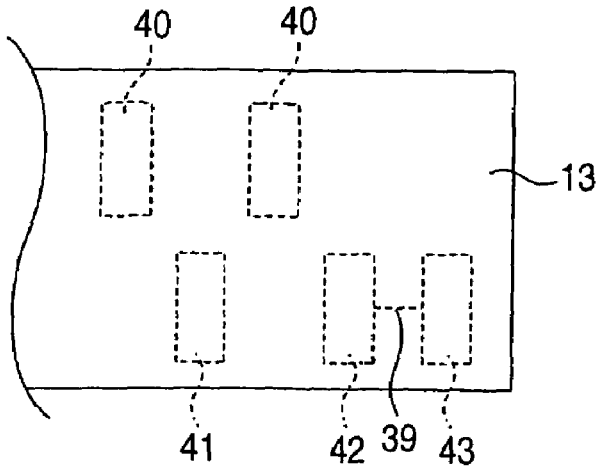
FIG. 5A is a schematic diagram illustrating a video signal line driving circuit in an enlarged view of a video-signal-line-side monitoring terminal portion Y shown in FIG. 4.
Figure 5B:
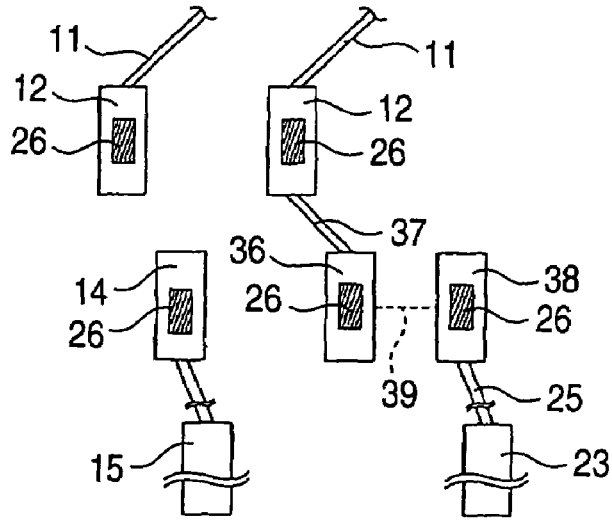
FIGS. 5B and 5C are schematic diagrams each illustrating a pattern formed on an insulating substrate in an enlarged view of the video-signal-line-side monitoring terminal portion Y shown in FIG. 4.
Figure 5C:
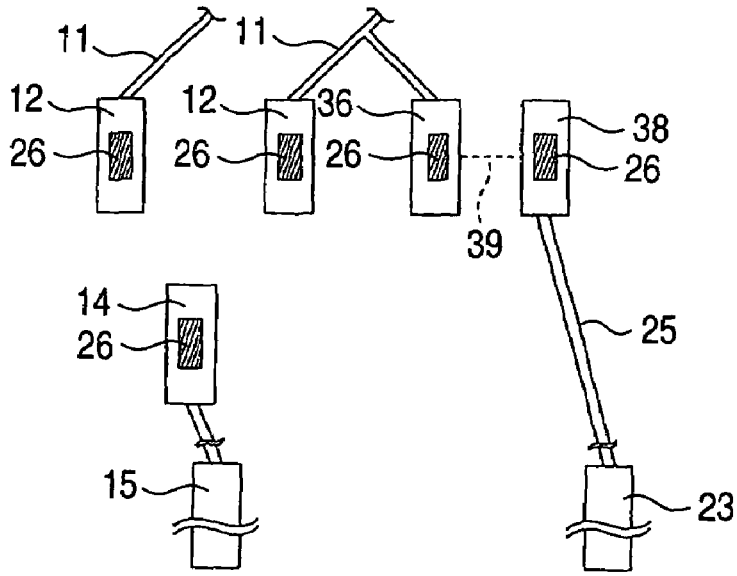

A second embodiment of the invention is described hereinbelow by referring to FIGS. 4 and 5A to 5C. FIG. 4 shows an equivalent circuit diagram illustrating a display apparatus according to the second embodiment of the invention. FIG. 5A shows a schematic diagram illustrating a video signal line driving circuit in an enlarged view of a video-signal-line-side monitoring terminal portion Y shown in FIG. 4. FIGS. 5B and 5(*c*) show schematic diagrams each illustrating a pattern formed on an insulating substrate in an enlarged view of the video-signal-line-side monitoring terminal portion Y.

In FIG. 4, constituent parts, which are the same as those shown in FIGS. 1 to 3, are designated by the same reference characters as those used in FIGS. 1 to 3. Thus, the differences between these embodiments are described hereinbelow. As shown in FIG. 4, for example, the signal line terminal 7 associated with the scanning line, which is connected to one of endmost wires of the group of scanning lines 4, is connected to, for instance, a scanning-line-side dummy terminal 32 serving as a terminal connected to a dummy bump of the scanning line driving circuit 8 by a wire 33 between the terminals of the scanning line driving circuit formed on the insulating substrate. Further, the scanning-line-side dummy terminal 32 is connected to an input terminal 34, which serves as a terminal connected to an adjacent scanning line monitoring terminal 18, for a scanning line monitoring terminal by the bump of the scanning line driving circuit 8, the conductive material, and the internal wire 35 of the scanning line driving circuit. Therefore, the scanning-line-side dummy terminal 32 is connected to the input terminal 34 for the scanning line monitoring terminal by the internal wire 35 of the scanning line driving circuit 8 to be mounted on the insulating substrate later, instead of a pattern formed thereon. Furthermore, the input terminal 34 for the scanning line monitoring terminal is connected to the scanning line monitoring terminal 18, which is formed in parallel with the scanning-line-side external terminal 10, by a scanning line monitoring wire 20.

Similarly, regarding the video signal line side, for example, the signal line terminal 12 associated with the video signal line, which is connected to one of endmost wires of the group of video signal lines 5, is connected to, for instance, a video-signal-line-side dummy terminal 36 serving as a terminal connected to a dummy bump of the video signal line driving circuit 13 by a wire 37 between the terminals of the video signal line driving circuit formed on the insulating substrate. Further, the video-signal-line-side dummy terminal 36 is connected to an input terminal 38, which serves as a terminal connected to an adjacent video signal line monitoring terminal 23, for a video signal line monitoring terminal by the bump of the video signal line driving circuit 13, the conductive material, and the internal wire 39 of the video signal line driving circuit. Therefore, the video-signal-line-side dummy terminal 36 is connected to the input terminal 38 for the video signal line monitoring terminal by the internal wire 39 of the video signal line driving circuit 13 to be mounted on the insulating substrate later, instead of a pattern formed thereon. Furthermore, the input terminal 38 for the video signal line monitoring terminal is connected to the video signal line monitoring terminal 23, which is formed in parallel with the video-signal-line-side external terminal 15, by a video signal line monitoring wire 25.

FIGS. 5A, 5B, and 5C are enlarged explanatory views showing a video-signal-line-side monitoring terminal portion Y shown in FIG. 4. FIG. 5A shows an outline of the video signal line driving circuit 13, and illustrates a bump 40 connected to a signal line terminal formed on the insulating substrate, which is connected to a signal line that is connected to a display area, a bump 41 connected to an input terminal 14 of the vide signal line driving circuit 13 formed on the insulating substrate, a bump 42 connected to the video-signal-line-side dummy terminal 36 formed on the insulating substrate, and a bump 43 connected to the video-signal-line-side dummy terminal 36 formed on the insulating substrate. Incidentally, the bumps 40 to 43 are indicated by dashed lines, because these bumps are disposed on the back side of paper, on the front side of which FIGS. 5A, 5B, and 5C are drawn.

The bump 42 connected to the video-signal-line-side dummy terminal 36 formed on the insulating substrate is connected to the bump 43 connected to the input terminal 38, which is formed on the insulating substrate, for the video signal line monitoring terminal by the internal wire 39 of the video-signal-line driving circuit. FIG. 5B shows an enlarged diagram illustrating an associated part on the insulating substrate, on which the video signal line driving circuit shown in FIG. 5A is mounted. As is seen from FIGS. 5A and 5B, the video-signal-line-side dummy terminal 36 formed on the insulating substrate is connected to the input terminal 38 for the video signal line monitoring terminal by mounting the video signal line driving circuit shown in FIG. 5A on the associated part on the insulating substrate, which is shown in FIG. 5B. Incidentally, the configuration of the terminals may be modified into the configuration in which the video signal line lead-out wire 11 is connected to the video-signal-line-side dummy terminal 36 by the pattern formed on the insulating substrate, instead of the configuration in which the video-signal-line-side dummy terminal 36 is connected by the wire 37 between the terminals to the signal line terminal 12 associated with the video signal line as shown in FIG. 5B. The remaining constituent parts are similar to those shown in FIG. 5B. Similarly to the aforementioned case, the video-signal-side dummy terminal 36 formed on the insulating substrate is connected to the input terminal 38 for the video signal line monitoring terminal by mounting thereon the video signal line driving circuit 13 having the arrangement of the terminals, which corresponds to the arrangement of the terminals shown in FIG. 5C.

Further, the process of connecting the video-signal-line-side dummy terminal 36 to the input terminal 38 for the video signal line monitoring terminal by the conductive material and the bump of the driving circuit is performed simultaneously with the process of connecting the signal line terminal 12, which is associated with the video signal line formed on the insulating substrate, to the bump of the driving circuit by the conductive material 26. Thus, the aforementioned configuration including the signal line monitoring terminal can be obtained without performing an additional process. Further, the process of forming the video-signal-line-side external terminal 15, the process of forming the video signal line monitoring terminal 23 in parallel with the external terminal 15, the process of forming the input terminal 38, which is connected to the video signal line monitoring terminal, for the video signal line monitoring terminal, and the process of forming the video-signal-line-side dummy terminal 36 connected to the signal line terminal, which is associated with a video signal line, or to the video signal line by the pattern formed on the insulating substrate are simultaneously performed at the same step. Thus, the configuration including the signal line monitoring terminal can be obtained without performing an additional process.

With the aforementioned configuration, the video-signal-line-side dummy terminal 36 is not connected to the input terminal 38 for the video signal line monitoring terminal until the driving circuits are mounted. Therefore, similarly to the first embodiment, in a case where static electricity enters the substrate from an external terminal, which is provided in the proximity of an end portion of the insulating substrate before the driving circuits are mounted, at that moment, the video-signal-line-side dummy terminal 36 is not connected to the input terminal 38 for the video signal line monitoring terminal. Thus, static electricity does not reach the display area. The electrostatic destruction of pixels does not occur. Generally, it is considered that most of the cases where static electricity externally enters the insulating substrate, the static electricity enters from a terminal formed in the vicinity of an end portion of the substrate. With the aforementioned configuration, even in a case where the signal line monitoring terminal is formed thereon, electrostatic destruction can be suppressed.

Further, as compared with the first embodiment, the second embodiment does not need to form the video signal line branch terminal and the internal terminal associated with the video signal line monitoring terminal in such a manner to provide a predetermined distance therebetween. The second embodiment can use two bumps connected by the internal wire of the driving circuit, among plural dummy bumps that the driving circuit generally has. Thus, the second embodiment can more easily obtain effects similar to those of the first embodiment.

Incidentally, similarly to the first embodiment, in the case of the second embodiment, after the driving circuits are connected thereto, the possibility of allowing static electricity to enter the substrate in the subsequent manufacturing process is low. Moreover, an input portion of the driving circuit is provided with a protective diode for preventing occurrence of electrostatic destruction. Thus, it is extremely seldom that static electricity externally enters and reaches the pixel of the display area and has adverse effects, such as electrostatic destruction. Further, after the drive circuits are connected thereto, electricity is conducted to the video signal line from the video signal line monitoring terminal through the video-signal-line-side dummy terminal, the input terminal for the video signal line monitoring terminal, and the internal wire of the video signal line driving circuit. This enables the monitoring of the video signal line. The defect analysis is enabled by monitoring variation in the potential applied on the signal line. Furthermore, the operability of a monitor can be enhanced by forming the video signal line monitoring terminal in the vicinity of an end portion of the insulating substrate in parallel with the external terminal associated with the video signal line.

In the foregoing description, the video-signal-line-side monitoring terminal portion has been described by referring to FIGS. 2A to 5C. Needless to say, similar effects can be obtained by employing a similar configuration as that of the scanning-line-side monitoring terminal portion. Further, the description of the first and second embodiments describes the case that the monitoring terminal is formed at the single endmost portion of each of the group of scanning lines and the group of video signal lines. The aforementioned configuration of the monitoring terminal can be applied to plural scanning lines or video signal lines, which are placed at predetermined positions in addition to the endmost portion.

Third Embodiment

Figure 6:
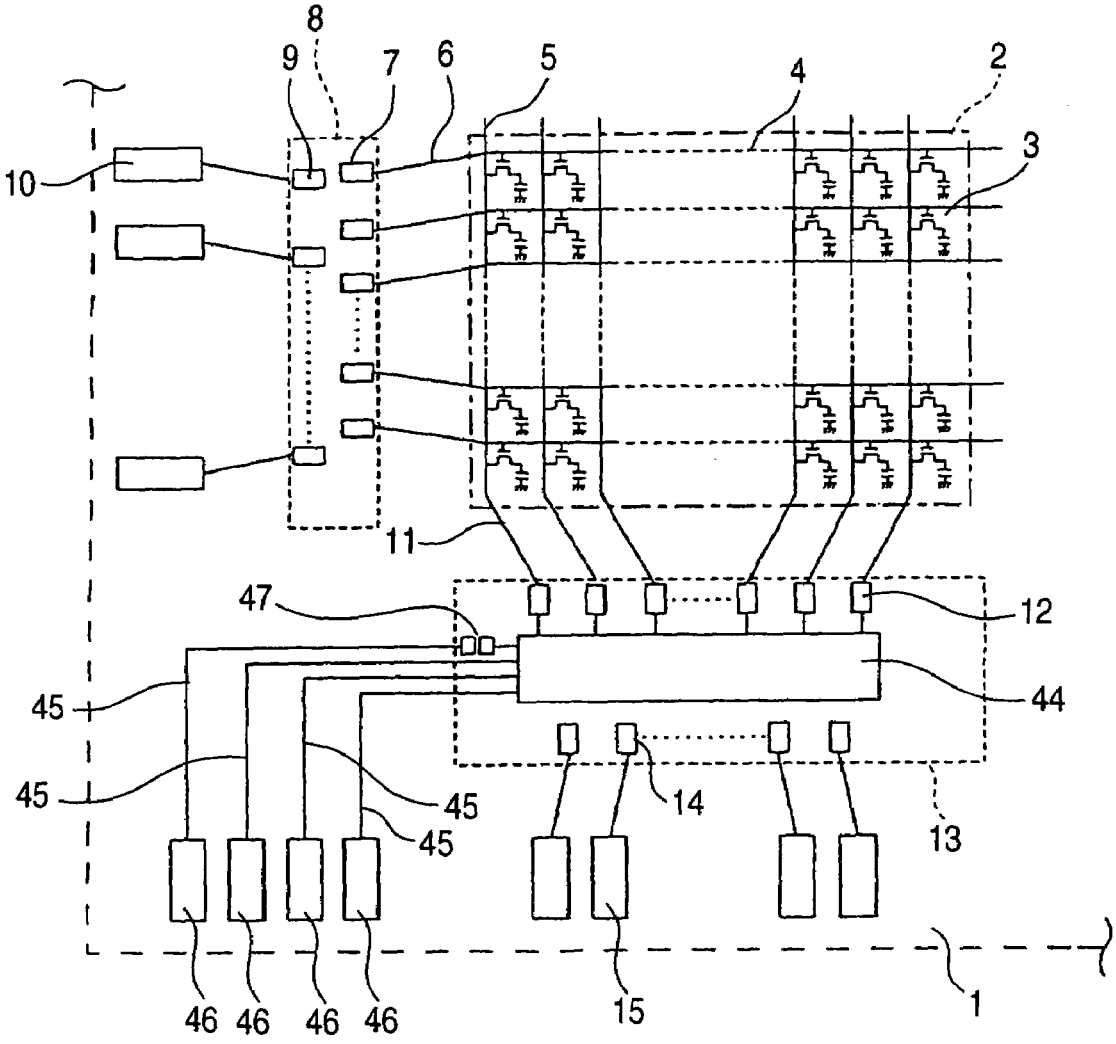
FIG. 6 is an equivalent circuit diagram illustrating a display apparatus according to a third embodiment of the invention.

A third embodiment of the invention is described herein below with reference to FIG. 6. FIG. 6 shows an equivalent circuit diagram illustrating a display apparatus according to the third embodiment of the invention.

In FIG. 6, constituent parts, which are the same as those shown in FIGS. 1 to 5C, are designated by the same reference characters as those used in FIGS. 1 to 5C. Thus, the differences among the embodiments are described hereinbelow. As shown in FIG. 6, an inspection circuit 44 is formed at the video-signal-line-side part on the insulating substrate. Inspection circuit wires 45 for inputting various signals to the inspection circuit 44 are connected to inspection terminals formed in parallel with the video-signal-line-side external terminals 15. Incidentally, similarly to the first and second embodiments, one of the inspection circuit wires 45 has an inspection circuit wire connecting portion 47. Incidentally, the inspection circuit is formed by being the signal line so as to detect various kinds of defects on a display and as to evaluate display irregularity. This inspection circuit may be set either in a manner in which the inspection circuit does not operate in a case that the display apparatus displays images as an actually completed product, or in a manner in which the inspection circuit can operate in such a case.

With such a configuration, the inspection terminals 46 are not connected to the inspection circuit 44 until the driving circuits are mounted. Therefore, similarly to the aforementioned embodiments, in a case where static electricity enters the substrate from an external terminal (an inspection terminal in the case of this third embodiment), which is provided in the proximity of an end portion of the insulating substrate before the driving circuits are mounted, at that moment, the inspection terminals 46 are not connected to the inspection circuit 44. Thus, naturally, the inspection terminals are not connected to the display area through the inspection circuit. Thus, static electricity does not reach the display area. Further, the electrostatic destruction of pixels does not occur. Generally, it is considered that most of the cases where static electricity externally enters the insulating substrate, the static electricity enters from a terminal formed in the vicinity of an end portion of the substrate. With the aforementioned configuration, even in a case where the signal line monitoring terminal is formed thereon, electrostatic destruction can be suppressed.

Although FIG. 6 shows the configuration in which the connecting portion 47 is provided corresponding to a part (or one) of the inspection circuit wires, the connecting portion 47 may be provided corresponding to each of plural or all of inspection circuit wires. Moreover, although the inspection circuit shown in FIG. 6 is connected to the signal line terminal 12 associated with the video signal line, the inspection circuit may be connected directly to, for example, the video signal line lead-out wire 11. Furthermore, although the description of the third embodiment has described the case where the inspection terminals are provided on the video signal line side, needless to say, similar effects can be obtained by providing similar inspection terminals on the scanning line side.

Incidentally, although the foregoing descriptions of the first, second and third embodiments have described the case where the driving circuits are directly mounted on the insulating substrate through the conductive material, the driving circuits may be mounted thereon through a film substrate or the like. Further, although the display apparatuses each provided with the thin film transistors have been described in the foregoing descriptions of the embodiments, the invention is not limited thereto. The invention may be applied to a passive-type display apparatus. Additionally, although the foregoing descriptions of the embodiments have described the case where the scanning line driving circuit and the video signal line driving circuit are respectively connected to the different sides of the display area, the invention may be applied to a display apparatus in which both of the scanning line driving circuit and the video signal line driving circuit are mounted on one of the sides of the display area. The invention is suitable for being applied to any display apparatus that has a monitoring terminal or an inspection terminal, which is formed in the vicinity of an insulating substrate, and a wire connecting and uses a liquid crystal or electroluminescence (EL) device.

What is claimed is:

1. An array substrate comprising:

an insulating substrate on which plural signal lines are formed;

a signal line terminal formed on the insulating substrate in such a manner as to be connected to a driving circuit, which supplies signals to the plural signal lines, by a conductive material;

an external terminal, formed in vicinity of an end portion of the insulating substrate, for externally supplying electrical potential to the driving circuit;

a signal line monitoring terminal formed in parallel with the external terminal;

a signal line branch terminal formed in such a way as to be connected to the signal line or to the signal line terminal; and an internal terminal associated with the signal line monitoring terminal, which is connected to the signal line monitoring terminal and connectable to the signal line branch terminal by the conductive material and a bump of the driving circuit.

2. A display apparatus comprising:

an insulating substrate on which plural signal lines are formed;

a signal line terminal formed on the insulating substrate in such a manner as to be connected to a driving circuit, which supplies signals to the plural signal lines, by a conductive material;

an external terminal, formed in vicinity of an end portion of the insulating substrate, for externally supplying electrical potential to the driving circuit;

a signal line monitoring terminal formed in parallel with the external terminal;

a signal line branch terminal formed in such a way as to be connected to the signal line or to the signal line terminal; and an internal terminal associated with the signal line monitoring terminal, which is connected to the signal line monitoring terminal and connectable to the signal line branch terminal by the conductive material and a bump of the driving circuit.

3. A display apparatus comprising:

an insulating substrate on which plural signal lines are formed;

a driving circuit, connected to a signal line terminal formed on the insulating substrate, for supplying signals to the plural signal lines;

an external terminal, formed in vicinity of an end portion of the insulating substrate, for externally supplying electrical potential to the driving circuit;

a signal line monitoring terminal formed in parallel with the external terminal;

an input terminal for the signal line monitoring terminal, which is connected to the signal line monitoring terminal; and a dummy terminal connected to the signal line terminal or to the signal line by a pattern formed on the insulating substrate, and characterized in that:

the input terminal for the signal line monitoring terminal, and the dummy terminal are connected to each other by the conductive material, a bump of the driving circuit, and a wire provide in the driving circuit.

4. A display apparatus comprising:

an insulating substrate on which plural signal lines are formed;

a signal line terminal formed on the insulating substrate in such a manner as to be connected to a driving circuit, which supplies signals to the plural signal lines, by a conductive material;

an external terminal, formed in vicinity of an end portion of the insulating substrate, for externally supplying electrical potential to the driving circuit;

an inspection terminal formed in parallel with the external terminal; and an inspection circuit connected to the signal line or to the signal line terminal, and characterized in that:

the inspection terminal and the inspection circuit are connected to each other by the conductive material and a bump of the driving circuit.

* * * * *